US007622681B2

(12) United States Patent
Kikuchi et al.

(10) Patent No.: US 7,622,681 B2
(45) Date of Patent: Nov. 24, 2009

(54) POLYGONAL OVERHEAD CABLE

(75) Inventors: Naoshi Kikuchi, Nikko (JP); Masao Kamiji, Tokyo (JP); Teruhiro Yukino, Abiko (JP); Katsuhiro Fujimoto, Hirakata (JP)

(73) Assignees: VISCAS Corporation, Tokyo (JP); Kansai Electric Power Co., Inc., Osaka (JP)

( * ) Notice: Subject to any disclaimer, the term of this patent is extended or adjusted under 35 U.S.C. 154(b) by 60 days.

(21) Appl. No.: 11/876,468

(22) Filed: Oct. 22, 2007

(65) Prior Publication Data

US 2008/0271910 A1 Nov. 6, 2008

(30) Foreign Application Priority Data

Oct. 23, 2006 (JP) ..... 2006-287146

(51) Int. Cl.
*H01B 5/08* (2006.01)

(52) U.S. Cl. ..... 174/128.2; 174/40 R

(58) Field of Classification Search ..... 174/40 R, 174/128.1, 128.2, 129 R
See application file for complete search history.

(56) References Cited

U.S. PATENT DOCUMENTS 5,711,143 A 1/1998 Munakata et al.
6,331,677 B1 12/2001 Munakata et al.
6,734,366 B2 5/2004 Kikuchi et al.
2002/0036092 A1 3/2002 Kikuchi et al.

FOREIGN PATENT DOCUMENTS

JP 2898903 3/1999
JP 3540720 4/2004

OTHER PUBLICATIONS

Takashi Nishihara et al., "Flow around a conductor with an 18-polygonal cross-section for overhead transmission line", Proceedings of the 3rd International Conference on Vortex Flows and Vortex Models, Nov. 21-23, 2005, 6 pages.
Takashi Nishihara et al., "Aerodynamic characterisitics and wind drag reduction mechanism of a newly developed conductor with an 18-polygonal cross-section for overhead transmission line", J. of Wind Engineering, vol. 31, No. 2(No. 107), ril 2006, pp. 25-34 and 83.

*Primary Examiner*—Chau N Nguyen
(74) *Attorney, Agent, or Firm*—Oblon, Spivak, McClelland, Maier & Neustadt, L.L.P.

(57) ABSTRACT

An overhead cable including a plurality of element wires stranded to form a naked stranded cable, which has a cross-sectional shape of an equilateral polygon inscribed in a circle having a diameter of 18.2 mm to 38.4 mm as a fundamental cross-sectional shape, in which two sides of this equilateral polygon that are located at positions farthest from each other are outwardly projected, has two flat-plate-shaped projections corresponding to the two sides, wherein the number of angles of the equilateral polygon is set depending to the diameter of the circle.

10 Claims, 6 Drawing Sheets

POLYGONAL OVERHEAD CABLE

CROSS-REFERENCE TO RELATED APPLICATIONS

This application is based upon and claims the benefit of priority from prior Japanese Patent Application No. 2006-287146, filed Oct. 23, 2006, the entire contents of which are incorporated herein by reference.

BACKGROUND OF THE INVENTION

1. Field of the Invention

The present invention relates to an overhead cable such as an overhead electric cable and an overhead earth cable and, more particularly, to an overhead cable which is less subject to a wind load under conditions of strong wind in a typhoon or the like or coexistence of strong wind and heavy rain, and which furthermore makes less wind noise at a medium wind speed.

2. Description of the Related Art

Conventionally, as an overhead cable in which a wind load is more reduced than in an aluminum conductor steel reinforced (ACSR) in which round element wires are stranded, an overhead cable in which spiral grooves are formed on the outer circumferential surface is known to the public (Japanese Patent No. 2898903, and Japanese Patent No. 3540720).

However, although these cables can reduce a wind load at the time of strong wind, these cables make large wind noise when wind having a wind speed of 10 to 20 m/s blows, and hence these cables are not suitable as overhead power transmission cables passing near private houses.

In order to reduce wind noise, it is effective to provide spiral projections on the overhead cable. According to the result of wind noise measurement carried out by means of wind tunnel facilities by using a cable described in Japanese Patent No. 3540720 on which spiral projections are provided, it was found that an effect of wind noise reduction cannot be obtained unless the size of the projection is made large because of the influence of the grooves formed on the surface of the cable. However, if the size of the spiral projections is increased, the drag coefficient becomes large and, as a result, the precious wind load reduction effect is deteriorated.

As described above, reduction of the wind load and reduction of the wind noise are in a conflicting relationship, and it has been difficult to make them compatible with each other.

BRIEF SUMMARY OF THE INVENTION

An object of the present invention is to provide an overhead cable which is less subject to a wind load even under conditions of not only strong wind but also coexistence of strong wind and heavy rain, and which can furthermore reduce wind noise at a medium wind speed.

According to a first aspect of the present invention, there is provided an overhead cable comprising a plurality of element wires stranded to form a naked stranded cable, which has a cross-sectional shape of an equilateral polygon inscribed in a circle having a diameter of 18.2 mm to 38.4 mm as a fundamental cross-sectional shape, in which two sides of this equilateral polygon that are located at positions farthest from each other are outwardly projected, has two flat-plate-shaped projections corresponding to the two sides, wherein the number of angles of the equilateral polygon is 16 when the diameter of the circle is 18.2 mm, the number of angles is 17 when the diameter is 22 mm, the number of angles is 20 when the diameter is 24.4 mm, the number of angles is 20 or 21 when the diameter is 27.4 mm, the number of angles is 22 when the diameter is 32.6 mm, and the number of angles is 22 when the diameter is 38.4 mm, and a height of the flat-plate-shaped projections is equal to or larger than 0.3 mm and equal to or smaller than 0.75 mm.

According to a second aspect of the present invention, there is provided an overhead cable comprising a plurality of element wires stranded to form a naked stranded cable, which has a cross-sectional shape of an equilateral polygon inscribed in a circle having a diameter of 18.2 mm to 38.4 mm as a fundamental cross-sectional shape, in which two sides of this equilateral polygon that are located at positions farthest from each other are outwardly projected, has two flat-plate-shaped projections corresponding to the two sides, wherein the number N of angles of the equilateral polygon and the diameter d of the circle satisfy the following equation, and a height of the flat-plate-shaped projections is equal to or larger than 0.3 mm and equal to or smaller than 0.75 mm.

$$192.245242-27.4410648d+1.52954875d^2-0.0360127956d^3+0.000306889377d^4-0.5<N<192.245242-27.4410648d+1.52954875d^2-0.0360127956d^3+0.000306889377d^4+0.5$$

According to a third aspect of the present invention, there is provided an overhead cable comprising a plurality of element wires stranded to form a naked stranded cable, which has a cross-sectional shape of an equilateral polygon inscribed in a circle having a diameter of 18.2 mm to 27.4 mm as a fundamental cross-sectional shape, in which two sides of this equilateral polygon that are located at positions farthest from each other are outwardly projected, has two flat-plate-shaped projections corresponding to the two sides, wherein the number N of angles of the equilateral polygon and the diameter d of the circle satisfy the following equation, and a height of the flat-plate-shaped projections is equal to or larger than 0.2 mm and equal to or smaller than 0.75 mm.

$$192.245242-27.4410648d+1.52954875d^2-0.0360127956d^3+0.000306889377d^4-0.5<N<192.245242-27.4410648d+1.52954875d^2-0.0360127956d^3+0.000306889377d^4+0.5$$

According to a fourth aspect of the present invention, there is provided an overhead cable comprising a plurality of element wires stranded to form a naked stranded cable, which has a cross-sectional shape of an equilateral polygon inscribed in a circle having a diameter of 22 mm to 38.4 mm as a fundamental cross-sectional shape, in which two sides of this equilateral polygon that are located at positions farthest from each other are outwardly projected, has two flat-plate-shaped projections corresponding to the two sides, wherein the number N of angles of the equilateral polygon and the diameter d of the circle satisfy the following equation, and a height of the flat-plate-shaped projections is equal to or larger than 0.3 mm and equal to or smaller than 1.0 mm.

$$192.245242-27.4410648d+1.52954875d^2-0.0360127956d^3+0.000306889377d^4-0.5<N<192.245242-27.4410648d+1.52954875d^2-0.0360127956d^3+0.000306889377d^4+0.5$$

According to a fifth aspect of the present invention, there is provided an overhead cable comprising a plurality of element wires stranded to form a naked stranded cable, which has a cross-sectional shape of an equilateral polygon inscribed in a circle having a diameter of 18.2 mm to 38.4 mm as a fundamental cross-sectional shape, in which two sides of this equilateral polygon that are located at positions farthest from each other are outwardly projected, has two flat-plate-shaped projections corresponding to the two sides, wherein the number N of angles of the equilateral polygon is within a range surrounded by straight lines connecting points (d=18; N=16), (d=22; N=17), (d=27.4; N=20), (d=32.6; N=22), (d=38.4; N=22), (d=32.6; N=22), (d=27.4; N=21), (d=24.4; N=20), and (d=18; N=16) on rectangular coordinates in which an abscissa indicates the diameter d of the circle, and an ordinate indicates the number N of angles, and a height of the two flat-plate-shaped projections is equal to or larger than 0.3 mm and equal to or smaller than 0.75 mm.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1A:
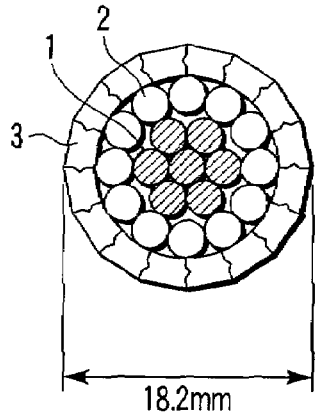
FIG. 1A is a cross-sectional view of an electric cable having a fundamental cross-sectional shape of an equilateral polygon having 16 angles and having an outer diameter of 18.2 mm.

The inventors of the present invention have confirmed through experiments that a wind load can be reduced by making a fundamental cross-sectional shape of an electric cable an equilateral polygon. Further, the inventors of the present invention have confirmed through experiments that it is possible to reduce wind noise while suppressing an increase in the wind load by spirally forming flat-plate-shaped projections having a small height on an outer circumferential surface of an overhead cable having a cross-sectional shape of an equilateral polygon.

The inventors of the present invention have completed an overhead cable which is less subject to a wind load under conditions of coexistence of strong wind and heavy rain, and which furthermore makes less wind noise at a wind speed of 10 to 20 m/s by making a fundamental cross-sectional shape of an electric cable an equilateral polygon and spirally forming flat-plate-shaped projections having a small height on an outer circumferential surface of an overhead cable having a cross-sectional shape of an equilateral polygon on the basis of these findings.

As described above, in the system in which the wind load is reduced by forming grooves on the circumferential surface of the overhead cable, it has been found that the problem is the wind noise at a wind speed of 10 to 20 m/s, and hence, first, the inventors of the present invention have preliminarily investigated whether or not the effect of the grooves (i.e., a change in pressure generated by the grooves) can be maintained by removing the grooves on the outer circumferential surface of the cable and compensating for the absence of the grooves by increasing or decreasing the number of angles of the equilateral polygon of the cross-section. This preliminary investigation has been made to study a relationship between the number of angles of a equilateral polygon and a wind load through a wind tunnel experiment by using a two-dimensional prism having a diameter identical with that of the equilateral polygon through a wind tunnel experiment. The inventors of the present invention have confirmed by this experiment that the drag coefficient Cd (that is, the wind load) can be made smaller even by using a simple equilateral prism having no grooves than in the case of an ordinary cable (Cd=1) in which round element wires are stranded as an outermost layer.

Then, the inventors of the present invention have experimentally manufactured an overhead cable having a cross-section of an equilateral polygon and having no grooves, and have conducted a wind tunnel experiment for reproducing conditions of strong wind and rain at the time of a typhoon. According to this experiment, it has been found that water drops adhering to the surface of the cable on the windward side move toward the wake side, and finally reach a burble point, and that behind the burble point, a backflow resulting from a vortex flow of the windward region occurs, and hence the water drops are forced back by the backflow to the burble point so as to be collected, thereby forming a puddle on the surface of the cable. Accordingly, it is conceivable that the wind load can be restricted to a small value even under conditions of strong wind and rain at the time of a typhoon if water drops collected at the position of the burble point can be removed or blown away by any means.

On the other hand, as the wind noise reduction measures for an overhead cable having a cross-sectional shape of an equilateral polygon, spiral projections are generally formed on the surface of the cable, which can be regarded as an effective method. In this method, as a phenomenon, a flow formed by the added spiral projection divides Karman's vortex streets formed by the cable main body which are in phase with each other into sections, thereby reducing the wind noise.

In consideration of the above-mentioned two phenomena, it is conceivable that an overhead cable which is practical and is effective for the environmental protection countermeasures can be provided if the problem of the stagnation and collection of the water drops on the surface of the cable occurring under conditions of strong wind and rain at the time of a typhoon which are in the high wind speed range, and the problem of the wind noise in the medium wind speed range can be solved by one item of countermeasures.

In order to solve the two problems described above, the inventors of the present invention thought that it might be possible to generate a strong flow from the projection so as to divide the Karman's vortex streets into sections and suppress the wind noise in the medium wind speed range, and to generate a forced burble from the projection so as to generate a strong flow on the cable surface, i.e., in the region of the boundary layer and blow the water drops off the cable surface at the time of high-speed wind and rain by setting equilateral polygons as the fundamental cross-sectional shape, by selecting the number of angles of an equilateral polygon excellent in water-removing capability from the fundamental cross-sectional shapes, and by further adding a pair of projections to the fundamental shape. For this purpose, projections that do not obstruct the surface flow of the overhead cable having a cross-sectional shape of an equilateral polygon are required.

First, the inventors of the present invention conducted an experiment for confirming a drag characteristic at the time of a typhoon not by using an electric cable but by using two-dimensional equilateral prism having the same cross-sectional shape as the electric cable so as to confirm a characteristic at the time of a rainfall of an electric cable having a fundamental cross-sectional shape of an equilateral polygon. This is because in the case of a naked stranded cable, it is predicted that the surface flow becomes a three-dimensional flow by the three-dimensionality of the shape of the electric cable (by the twist in the twisting direction), the motion of the water drops on the cable surface is made complicated, and grasp and comprehension of the phenomenon are made difficult. By assuming the fundamental cross-sectional shape to be a two-dimensional equilateral polygon (of a two-dimensional equilateral prism), it is possible to suppress the complexity of the phenomenon, facilitate grasp and comprehension of the phenomenon, and make it easy to search for a desirable cross-sectional shape (number of angles).

For the purpose of the shape search, two-dimensional equilateral prisms of an equilateral polygon having 15 angles, equilateral polygon having 16 angles, and equilateral polygon having 17 angles each of which was inscribed in a circle having a diameter of 18 mm, an equilateral polygon having 16 angles, equilateral polygon having 17 angles, equilateral polygon having 18 angles, and equilateral polygon having 20 angles each of which was inscribed in a circle having a diameter of 22 mm, an equilateral polygon having 18 angles, equilateral polygon having 20 angles, and equilateral polygon having 22 angles each of which was inscribed in a circle having a diameter of 25 mm, an equilateral polygon having 20 angles, and equilateral polygon having 22 angles each of which was inscribed in a circle having a diameter of 27 mm, an equilateral polygon having 20 angles, and equilateral polygon having 22 angles each of which was inscribed in a circle having a diameter of 34 mm, and an equilateral polygon having 22 angles, and equilateral polygon having 24 angles each of which was inscribed in a circle having a diameter of 40 mm were experimentally manufactured.

Wind tunnel experiments were conducted for these prisms so as to measure drag coefficients at the time of strong wind and rain at wind speeds ranging from 5 m/s to 40 m/s, under rainfall conditions of 16 mm/10 min. Normally, the maximum wind speed used in designing of power transmission line facilities is 40 m/s, and the maximum wind speed of these experiments was therefore set to 40 m/s. The rainfall conditions correspond to a value quoted from the records of strong wind and amounts of precipitation of typhoons observed in the past.

Figure 13:
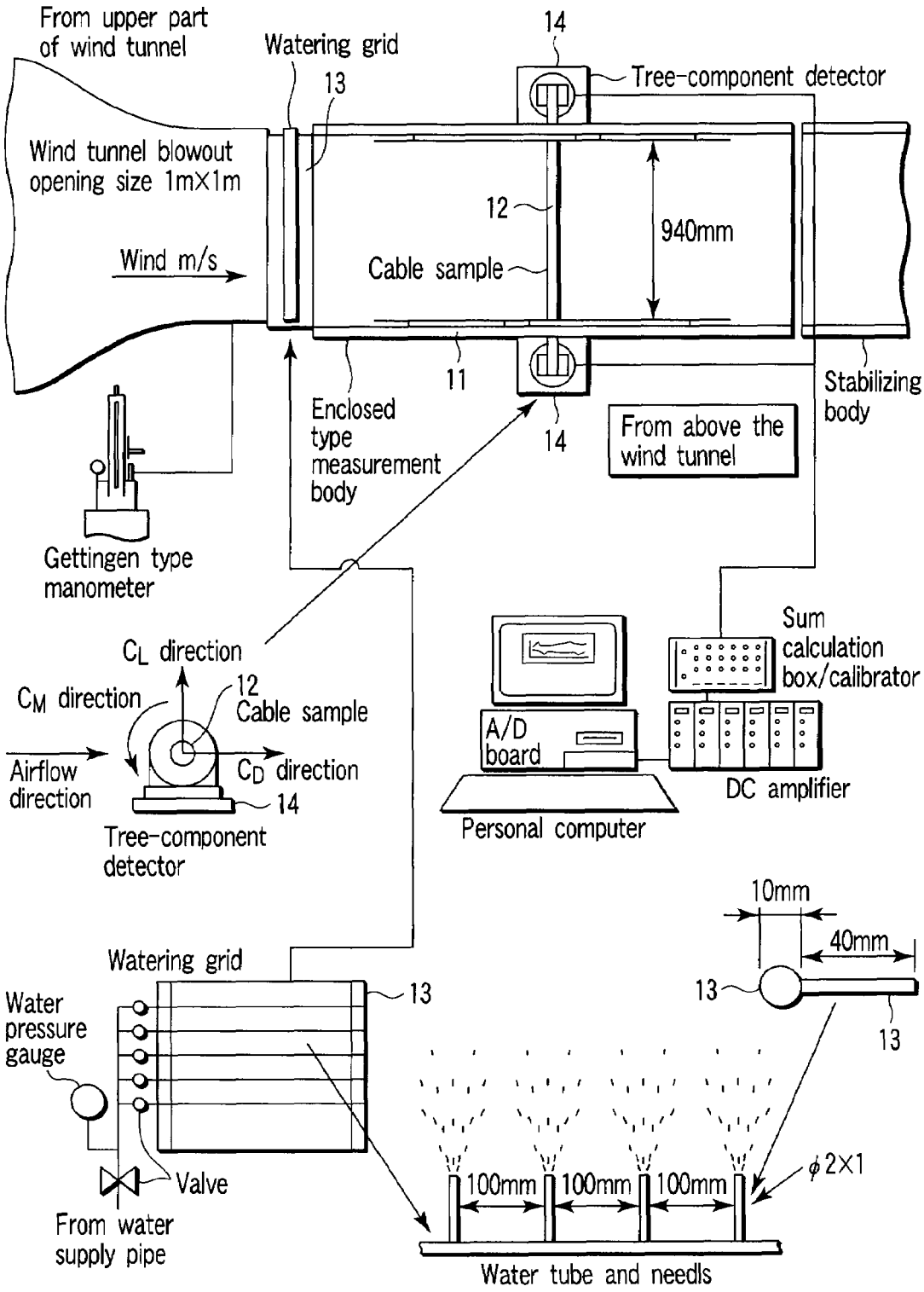
FIG. 13 is an explanatory view of wind tunnel experimental facilities.

The wind tunnel experiments were carried out by using the experimental facilities shown in FIG. 13. In the experimental facilities, a cable sample 12 is vertically arranged in the wind tunnel 11, and water is jetted from a watering grid 13 arranged immediately after an entrance (blowout opening) of the wind tunnel 11 so as not to disturb the airflow under conditions of a wind speed of 40 m/s. The jetted water diffuses in the airflow, reaches the cable sample 12 together with the airflow, and passes through the wind tunnel. The wind pressure applied to the cable sample 12 is detected by three-component detectors 14 (load meters) arranged on both sides of the wind tunnel 11.

The definition of the drag coefficient Cd is as shown by the following formula.

$$Cd = \text{measuring load}/(0.5\rho V^2 A)$$

where measuring load is a sum of the load meters provided on both sides of the wind tunnel, ρ is air density, V is an airflow speed, and A is a windward-projected cross-sectional area of the cable sample.

In the formula, $0.5\rho V^2$ corresponds to a wind pressure value, and is a wind pressure load per unit area. In the standard atmospheric pressure state, $\rho=1.293$ kg/m$^3$ at a wind speed of 40 m/s, and hence the wind pressure value becomes 980.7 N/m$^2$. The wind pressure value becomes 551.6 N/m$^2$ at a wind speed of 30 m/s.

In the estimation at the time of a rainfall, the above formula is not changed, and the same value of ρ as that at the time of no rainfall is used as the air density ρ. Thus, the effect of rainfall appearing in the measuring load directly appears in the Cd value, thereby facilitating evaluation.

Results of the wind tunnel experiments of the two-dimensional equilateral prisms are shown in Table 1 below.

TABLE 1

Test results of two-dimensional prism

| Diameter mm | Number of angles of prism | Non-rainfall Cd | Rainfall Cd | Employed Cd | Effective shape |
|---|---|---|---|---|---|
| 18 | 15 | 0.674 | 0.888 | 0.888 | |
| 18 | 16 | 0.803 | 0.891 | 0.891 | |
| 18 | 18 | 0.848 | 0.772 | 0.848 | ○ |
| 22 | 16 | 0.721 | 0.902 | 0.902 | |
| 22 | 17 | 0.608 | 0.829 | 0.829 | |
| 22 | 18 | 0.577 | 0.804 | 0.804 | ○ |
| 22 | 20 | 0.677 | 0.818 | 0.818 | |
| 25 | 18 | 0.563 | 0.788 | 0.788 | ○ |
| 25 | 20 | 0.533 | 0.820 | 0.820 | |
| 25 | 22 | 0.88 | 0.747 | 0.880 | |
| 27 | 20 | 0.657 | 0.778 | 0.778 | |
| 27 | 22 | 0.513 | 0.712 | 0.712 | ○ |
| 32 | 20 | 0.656 | 0.760 | 0.760 | |
| 32 | 22 | 0.561 | 0.726 | 0.726 | ○ |
| 40 | 22 | 0.521 | 0.717 | 0.717 | ○ |
| 40 | 24 | 0.463 | 0.726 | 0.726 | |

○: very good

On the basis of the test results shown in above Table 1, the numbers of angles of the polygonal prisms of the respective diameters each having a small value of the wind pressure resistance for both the non-rainfall and rainfall were searched for. The results are, as shown by circular marks ○ in Table 1, 18 angles are selected for the diameter of 18 mm, 18 angles for the diameter of 22 mm, 18 angles for the diameter of 25 mm, 22 angles for the diameter of 27 mm, 22 angles for the diameter of 32 mm, and 22 angles for the diameter of 40 mm. On the basis of the above results, the number of angles was determined in accordance with the diameter of each of the actual electric cables, and overhead cables each having a cross-sectional shape of an equilateral polygon and each constituted of a naked stranded cable were experimentally manufactured.

Electric cables experimentally manufactured are as follows.

As for the electric cables each having a diameter of 18.2 mm (corresponding to a nominal cross-sectional area of 160 mm$^2$), a cable of an equilateral polygon having 14 angles (illustration omitted), a cable of an equilateral polygon having 15 angles (illustration omitted), and a cable of an equilateral polygon having 16 angles shown in FIG. 1A were experimentally manufactured.

Figure 2A:
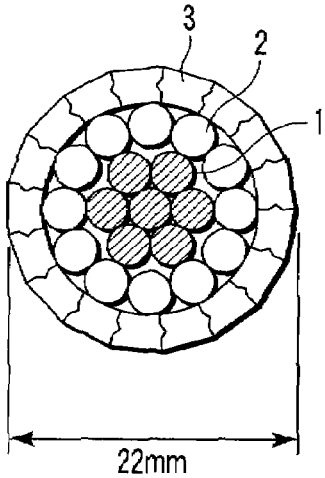
FIG. 2A is a cross-sectional view of an electric cable having a fundamental cross-sectional shape of an equilateral polygon having 17 angles and having an outer diameter of 22 mm.

As for the electric cables each having a diameter of 22 mm (corresponding to a nominal cross-sectional area of 240 mm$^2$), a cable of an equilateral polygon having 17 angles shown in FIG. 2A, and a cable of an equilateral polygon having 20 angles (illustration omitted) were experimentally manufactured.

Figure 3A:
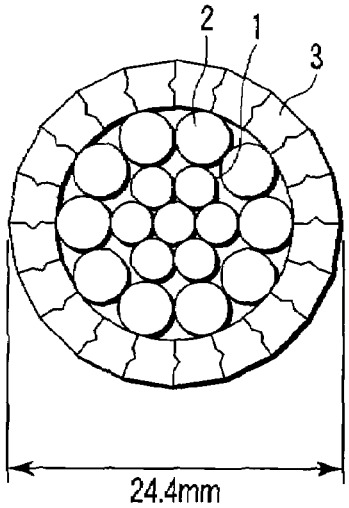
FIG. 3A is a cross-sectional view of an electric cable having a fundamental cross-sectional shape of an equilateral polygon having 16 angles and having an outer diameter of 24.4 mm.

As for the electric cable having a diameter of 24.4 mm (corresponding to a nominal cross-sectional area of 330 mm$^2$), a cable of an equilateral polygon having 20 angles shown in FIG. 3A was experimentally manufactured.

Figure 4A:
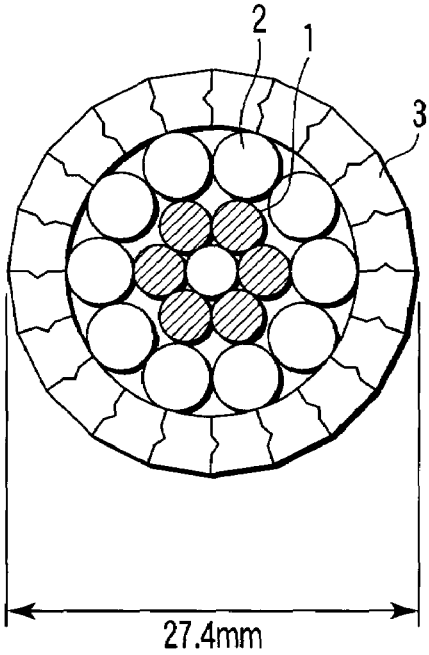
FIG. 4A a cross-sectional view of an electric cable having a fundamental cross-sectional shape of an equilateral polygon having 20 angles and having an outer diameter of 27.4 mm.
Figure 5A:
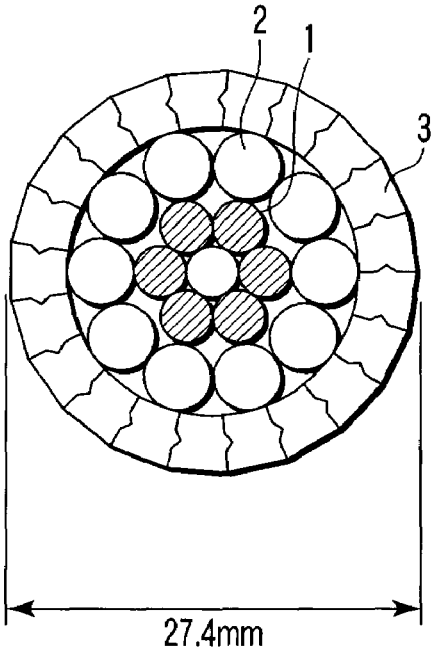
FIG. 5A is a cross-sectional view of an electric cable having a fundamental cross-sectional shape of an equilateral polygon having 21 angles and having an outer diameter of 27.4 mm.

As for the electric cables each having a diameter of 27.4 mm (corresponding to a nominal cross-sectional area of 410 mm$^2$), a cable of an equilateral polygon having 20 angles shown in FIG. 4A, and a cable of an equilateral polygon having 21 angles shown in FIG. 5A were experimentally manufactured.

Figure 6A:
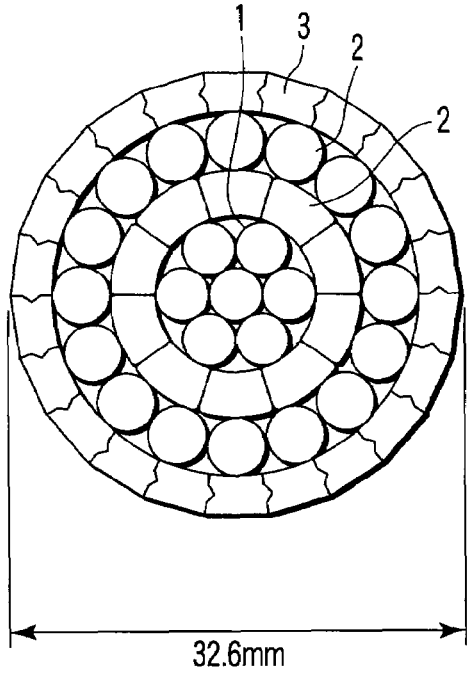
FIG. 6A is a cross-sectional view of an electric cable having a fundamental cross-sectional shape of an equilateral polygon having 22 angles and having an outer diameter of 32.6 mm.

As for the electric cable having a diameter of 32.6 mm (corresponding to a nominal cross-sectional area of 610 mm$^2$), a cable of an equilateral polygon having 22 angles shown in FIG. 6A was experimentally manufactured.

Figure 7A:
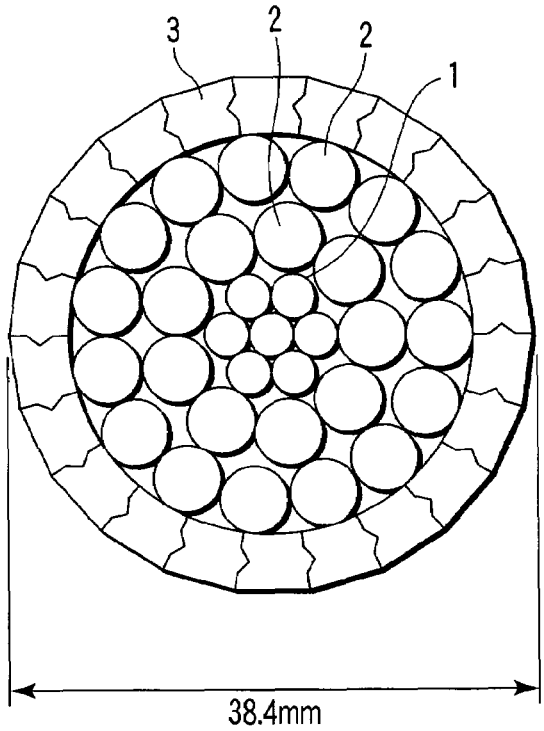
FIG. 7A is a cross-sectional view of an electric cable having a fundamental cross-sectional shape of an equilateral polygon having 22 angles and having an outer diameter of 38.4 mm.

As for the electric cables each having a diameter of 38.4 mm (corresponding to a nominal cross-sectional area of 810 mm$^2$), a cable of an equilateral polygon having 22 angles shown in FIG. 7A, and a cable of an equilateral polygon having 24 angles (illustration omitted) were experimentally manufactured.

In FIGS. 1A to 7B, a reference numeral 1 denotes central stranded steel wires, 2 denotes inner layer aluminum element wires, and 3 denotes outermost layer aluminum element wires. In each electric cable, the outermost layer aluminum element wire 3 has, as shown in FIG. 8A, a substantially trapezoidal cross-sectional shape, has a convex stripe 4 extending in the longitudinal direction on one side surface in contact with an adjacent element wire, has a concave stripe 5 corresponding to the stripe 4 on the other side surface, has a flat surface on the outer surface side, and has a curved surface corresponding to a diameter of the inner layer on the inner surface side. By using such element wires 3 in the outermost layer, positional displacement between each outermost layer element wire hardly occurs, and a stranded cable having a cross-sectional shape of an accurate equilateral polygon can be formed.

Incidentally, the reason for not experimentally manufacturing two-dimensional prisms of an equilateral polygon having 18 angles corresponding the effective number of angles in the test results of the two-dimensional prisms for the electric cables having diameters of 22 mm and 24.4 mm is that the test results of the prisms show discontinuity at the diameters of 25 mm and 27 mm. Further, the experimental test was carried out in sequence in the order from the larger diameter. As a result, it was found that 17 a polygon having 17 angles was effective for the cable having a diameter of 22 mm, and hence cables of polygons having 14, 15, and 16 angles became the objects of the experimental manufacture for the cables each having a diameter of 18.2 mm.

Results of the wind tunnel experiments of the experimentally manufactured overhead cables each having a cross-sectional shape of an equilateral polygon (fundamental shape) are shown in Table 2 below. Table 2 shows a diameter d, nominal cross-sectional area, number N of angles, drag coefficient at a wind speed of 20 m/s under conditions of no rainfall, drag coefficient at a wind speed of 30 m/s under conditions of no rainfall, drag coefficient at a wind speed of 40 m/s under conditions of no rainfall, and drag coefficient at a wind speed of 40 m/s and under conditions of rainfall of 16 mm/10 min., of each overhead cable having a cross-sectional shape of an equilateral polygon.

TABLE 2

| Cable diameter d | Nominal cross-sectional area mm² | Number of angles N | Drag coefficient of fundamental shape projection height: 0 mm — Drag coefficient, no rainfall 20 m/s | 30 m/s | 40 m/s | Drag coefficient, rainfall 16 mm/10 min. 40 m/s | Execution Cd | Employment |
|---|---|---|---|---|---|---|---|---|
| 18.2 | 160 | 14 | 1.246 | 1.233 | 1.192 | 0.912 | 1.192 | |
| 18.2 | 160 | 15 | 1.238 | 1.215 | 1.169 | 0.908 | 1.169 | |
| 18.2 | 160 | 16 | 1.264 | 1.254 | 1.012 | 0.868 | 1.012 | Δ |
| 22 | 240 | 17 | 1.158 | 1.121 | 0.831 | 0.812 | 0.831 | ◎ |
| 22 | 240 | 20 | 1.226 | 1.212 | 1.036 | 0.890 | 1.036 | |
| 24.4 | 330 | 20 | 1.279 | 1.124 | 0.754 | 0.750 | 0.754 | ◎ |
| 27.4 | 410 | 20 | 1.054 | 0.782 | 0.642 | 0.763 | 0.763 | ◎ |
| 27.4 | 410 | 21 | 1.058 | 0.822 | 0.628 | 0.742 | 0.742 | ○ |
| 32.6 | 610 | 22 | 0.985 | 0.668 | 0.611 | 0.711 | 0.711 | ◎ |
| 38.4 | 810 | 22 | 0.908 | 0.583 | 0.532 | 0.721 | 0.721 | ◎ |
| 38.4 | 810 | 24 | 0.968 | 0.841 | 0.782 | 0.812 | 0.812 | |

◎: excellent
○: very good
Δ: good

When these electric cables are evaluated, as the wind pressure load value necessary for design, a value of Cd having a large value is employed for the respective conditions, and hence a drag coefficient Cd value of non-rainfall at a wind speed of 40 m/s and a drag coefficient Cd value of a rainfall at a wind speed of 40 m/s are compared with each other. Thus, a Cd value having the larger value is employed as the drag coefficient of the cable at the time of a typhoon. The execution Cd in Table 2 is the larger Cd value at the time of the comparison of the two Cd values, and this value is a value indicative of the drag coefficient at the time of a typhoon.

Evaluations of the experimentally manufactured overhead cables each having a cross-sectional shape of a equilateral polygon (fundamental shape) are as follows.

(1) Aerial Cable of an Equilateral Polygon Having a Diameter of 18.2 mm

As for this size, three types of electric cables were experimentally manufactured and tested. As shown in Table 2, the cable in which the drag coefficient at the time of a rainfall is the smallest is that of 16 angles, and the effect thereof is that the Cd value thereof is 0.868 of a design Cd value of a corresponding normal cable (ACSR), which means a reduction in a wind pressure load of slightly less than 14%. However, the Cd value at the time of no rainfall is 1.012, which is a value somewhat larger than a Cd value 1.0 of a cable at a wind speed of 40 m/s used in the design of a power transmission line.

(2) Aerial Cable of an Equilateral Polygon Having a Diameter of 22 mm

As for this size, two types of electric cables were experimentally manufactured and tested. As shown in Table 2, the cable of the equilateral polygon having 17 angles was better, and the Cd value of 0.831 of the cable of the equilateral polygon having 17 angles at the time of no rainfall was employed as the execution Cd value. This value was less than a design Cd value 1.0 of a corresponding normal cable by about 17%, and hence a sufficient wind pressure load reduction effect was obtained.

(3) Aerial Cable of an Equilateral Polygon Having a Diameter of 24.4 mm

As for this size, one types of an electric cable of the equilateral polygon having 20 angles was experimentally manufactured and tested. As shown in Table 2, the drag coefficient at the time of a rainfall was employed as the execution Cd value, which was 0.754. This value was less than a design Cd value 1.0 of a corresponding normal cable by about 24%, and hence a sufficient wind pressure load reduction effect was obtained.

(4) Aerial Cable of an Equilateral Polygon Having a Diameter of 27.4 mm

As for this size, two types of electric cables were experimentally manufactured and tested. As shown in Table 2, satisfactory results were obtained for both the equilateral 20-angle polygonal cable and the equilateral 21-angle polygonal cable. In the equilateral 20-angle polygonal cable, the Cd value 0.763 at the time of a rainfall was employed as the execution Cd value and, in the equilateral 21-angle polygonal cable, the Cd value 0.742 at the time of a rainfall was employed as the execution Cd value. The Cd value of the equilateral 21-angle polygonal cable was less than a design Cd value 1.0 of a corresponding normal cable by about 26%, and hence a sufficient wind pressure load reduction effect was obtained.

(5) Aerial Cable of an Equilateral Polygon Having a Diameter of 32.6 mm

As for this size, one type of an equilateral 22-angle polygon electric cable was experimentally manufactured and tested. As shown in Table 2, the drag coefficient at the time of a rainfall was employed as the execution Cd value, which was 0.711. This value was less than a design Cd value 1.0 of a corresponding normal cable by about 29%, and hence a sufficient wind pressure load reduction effect was obtained.

(6) Aerial Cable of an Equilateral Polygon Having a Diameter of 38.4 mm

As for this size, two types of electric cables were experimentally manufactured and tested. As shown in Table 2, the equilateral 22-angle polygonal cable showed a satisfactory result, and the Cd vale 0.721 of the equilateral 22-angle polygonal cable at the time of a rainfall was employed as the execution Cd value. This value was less than a design Cd value 1.0 of a corresponding normal cable by about 28%, and hence a sufficient wind pressure load reduction effect was obtained.

From the results of the experiments described above, it was found that in the case of the electric cables each constituted of a naked stranded cable having a cross-sectional shape of an equilateral polygon, when the diameter is 18.2 mm, the equilateral 16-angle polygon provides the lowest Cd value, when the diameter is 22 mm, the equilateral 17-angle polygon provides the lowest Cd value, when the diameter is 24.4 mm, the equilateral 20-angle polygon provides the lowest Cd value, when the diameter is 27.4 mm, the equilateral 20-angle polygon or the equilateral 21-angle polygon provides the lowest Cd value, when the diameter is 32.6 mm, the equilateral 22-angle polygon provides the lowest Cd value, and when the diameter is 38.4 mm, the equilateral 22-angle polygon enables the wind pressure load to be lower than the normal electric cable.

Next, wind noise level measurement was carried out at wind speeds of 10 m/s, 15 m/s, and 20 m/s for each of the above 7 types of equilateral polygon overhead cables. The wind noise level measurement was also carried out for a normal electric cable (ACSR formed by stranding round element wires) having the same nominal cross-sectional area for comparison, and the results are also shown in Table 3.

TABLE 3

| Wind noise level of fundamental shape projection height: 0 mm | | | | | | |
|---|---|---|---|---|---|---|
| Cable diameter d | Nominal cross-sectional area $mm^2$ | Number of angles N | Peak noise level 10 m/s | 15 m/s | 20 m/s | Evaluation |
| 18.2 | ACSR160 | | 44.0 | 56.1 | 71.6 | |
| 18.2 | 160 | 16 | 42.5 | 54.9 | 70.5 | ○ |
| 22.4 | ACSR240 | | 41.3 | 55.9 | 66.9 | |
| 22 | 240 | 17 | 40.9 | 50.4 | 57.4 | ○ |
| 25.3 | ACSR330 | | 34.7 | 55.0 | 63.3 | |
| 24.4 | 330 | 20 | 39.9 | 47.8 | 64.7 | X |
| 28.5 | ACSR410 | | 38.0 | 54.9 | 57.9 | |
| 27.4 | 410 | 20 | 34.2 | 54.3 | 62.7 | X |
| 27.4 | 410 | 21 | 31.7 | 53.4 | 62.3 | X |
| 34.2 | ACSR610 | | 34.9 | 51.2 | 54.0 | |
| 32.6 | 610 | 22 | 36.4 | 48.9 | 62.9 | X |
| 38.4 | ACSR810 | | 39.5 | 43.0 | 53.9 | |
| 38.4 | 810 | 22 | 38.7 | 46.2 | 60.9 | X |

○: very good
X: bad

According to Table 3, it was found that in the cables having the nominal cross-sectional areas of 160 $mm^2$ and 240 $mm^2$, the equilateral polygon overhead cables make the wind noise lower than the normal cables, but in the cables having the nominal cross-sectional areas of 330 $mm^2$ to 810 $mm^2$, the equilateral polygon overhead cables make the wind noise higher than the normal cables.

Thus, as a result of searching for means for reducing the wind noise of the cables each having the equilateral polygon as the fundamental shape within a range in which the wind pressure load reduction effect of the equilateral polygon overhead cables was not deteriorated, it was experimentally found effective to provide flat-plate-shaped projections each having a relatively small height in a spiral form.

Thus, in order to investigate the effect of the height of the flat-plate-shaped projection, following cables in which the height of the flat-plate-shaped projection was changed were experimentally manufactured.

Figure 1B:
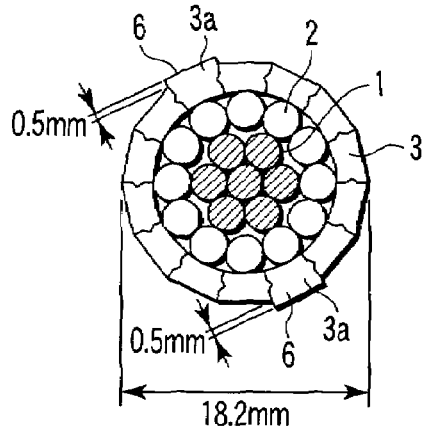
FIG. 1B is a cross-sectional view of an electric cable formed by forming flat-plate-shaped projections on the electric cable shown in FIG. 1A according to one embodiment of the present invention.

(1) Five types of electric cables each of which has an equilateral polygon having 16 angles inscribed in a circle having a diameter of 18.2 mm shown in FIG. 1B as a fundamental cross-sectional shape, and in each of which a side and another side located at a position farthest from the former side are outwardly projected so as to be provided with flat-plate-shaped projections 6, and a height of the flat-plate-shaped projections is one of 0.2 mm, 3.3 mm, 0.5 mm, 0.75 mm, and 1.0 mm.

Figure 2B:
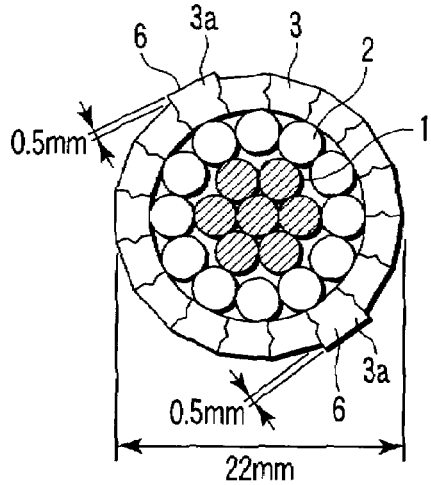
FIG. 2B is a cross-sectional view of an electric cable formed by forming flat-plate-shaped projections on the electric cable shown in FIG. 2A according to another embodiment of the present invention.

(2) Five types of electric cables each of which has an equilateral polygon having 17 angles inscribed in a circle having a diameter of 22 mm shown in FIG. 2B as a fundamental cross-sectional shape, and in each of which a side and another side located at a position farthest from the former side are outwardly projected so as to be provided with flat-plate-shaped projections 6, and a height of the flat-plate-shaped projections is one of 0.2 mm, 3.3 mm, 0.5 mm, 0.75 mm, and 1.0 mm.

Figure 3B:
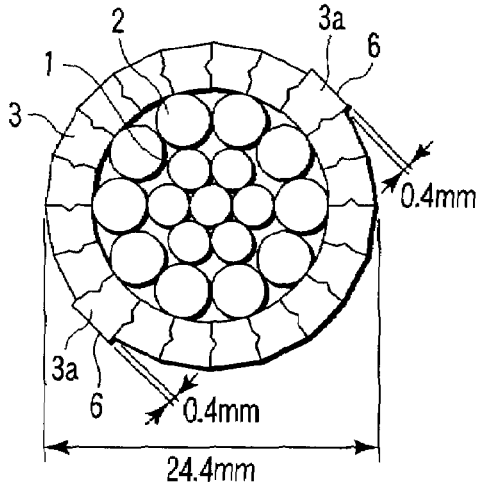
FIG. 3B is a cross-sectional view of an electric cable formed by forming flat-plate-shaped projections on the electric cable shown in FIG. 3A according to still another embodiment of the present invention.

(3) Five types of electric cables each of which has an equilateral polygon having 20 angles inscribed in a circle having a diameter of 24.4 mm shown in FIG. 3B as a fundamental cross-sectional shape, and in each of which a side and another side located at a position farthest from the former side are outwardly projected so as to be provided with flat-plate-shaped projections 6, and a height of the flat-plate-shaped projections is one of 0.2 mm, 3.3 mm, 0.5 mm, 0.75 mm, and 1.0 mm.

Figure 4B:
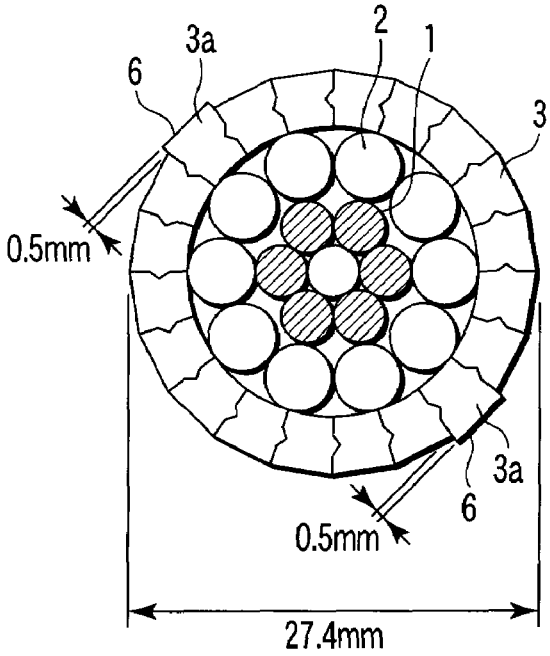
FIG. 4B is a cross-sectional view of an electric cable formed by forming flat-plate-shaped projections on the electric cable shown in FIG. 4A according to still another embodiment of the present invention.

(4) Five types of electric cables each of which has an equilateral polygon having 20 angles inscribed in a circle having a diameter of 27.4 mm shown in FIG. 4B as a fundamental cross-sectional shape, and in each of which a side and another side located at a position farthest from the former side are outwardly projected so as to be provided with flat-plate-shaped projections 6, and a height of the flat-plate-shaped projections is one of 0.2 mm, 3.3 mm, 0.5 mm, 0.75 mm, and 1.0 mm.

Figure 5B:
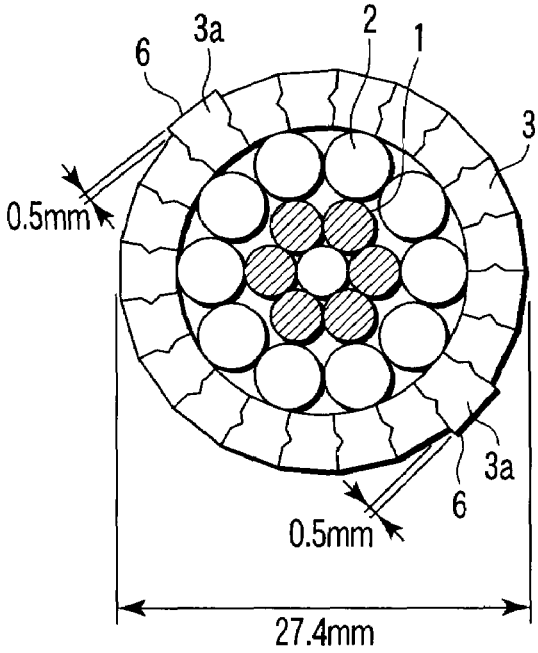
FIG. 5B is a cross-sectional view of an electric cable formed by forming flat-plate-shaped projections on the electric cable shown in FIG. 5A according to still another embodiment of the present invention.

(5) Five types of electric cables each of which has an equilateral polygon having 21 angles inscribed in a circle having a diameter of 27.4 mm shown in FIG. 5B as a fundamental cross-sectional shape, and in each of which a side and another side located at a position farthest from the former side are outwardly projected so as to be provided with flat-plate-shaped projections 6, and a height of the flat-plate-shaped projections is one of 0.2 mm, 3.3 mm, 0.5 mm, 0.75 mm, and 1.0 mm.

Figure 6B:
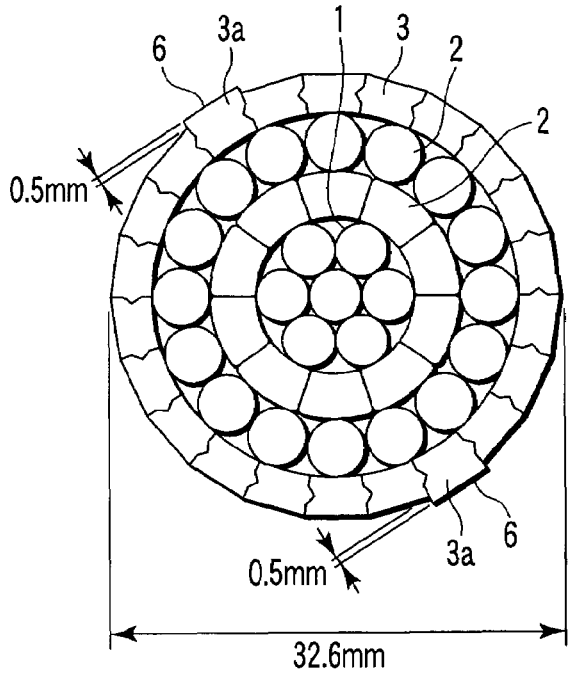
FIG. 6B is a cross-sectional view of an electric cable formed by forming flat-plate-shaped projections on the electric cable shown in FIG. 6A according to still another embodiment of the present invention.

(6) Five types of electric cables each of which has an equilateral polygon having 22 angles inscribed in a circle having a diameter of 32.6 mm shown in FIG. 6B as a fundamental cross-sectional shape, and in each of which a side and another side located at a position farthest from the former side are outwardly projected so as to be provided with flat-plate-shaped projections 6, and a height of the flat-plate-shaped projections is one of 0.2 mm, 3.3 mm, 0.5 mm, 0.75 mm, and 1.0 mm.

Figure 7B:
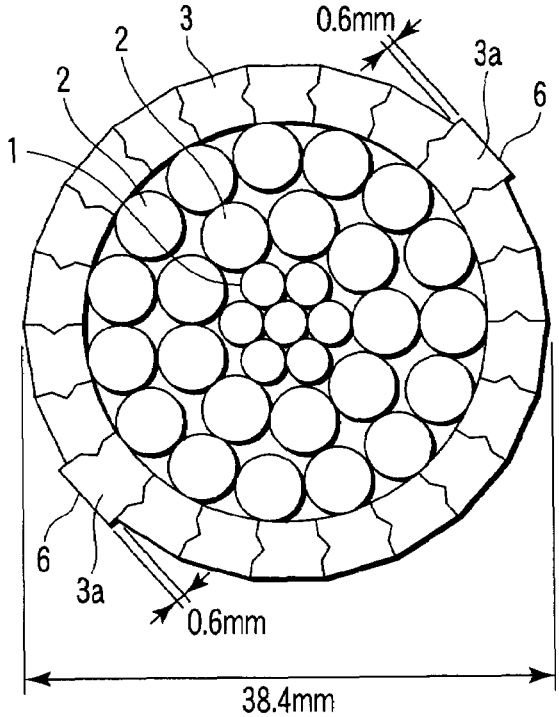
FIG. 7B is a cross-sectional view of an electric cable formed by forming flat-plate-shaped projections on the electric cable shown in FIG. 7A according to still another embodiment of the present invention.
Figure 8A:
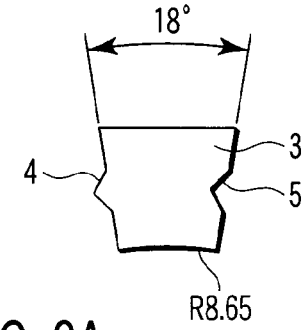
FIG. 8A is a cross-sectional view showing an example of an outermost layer element wire for forming an overhead cable having a cross-sectional shape of an equilateral polygon.

(7) Five types of electric cables each of which has an equilateral polygon having 22 angles inscribed in a circle having a diameter of 38.4 mm shown in FIG. 7B as a fundamental cross-sectional shape, and in each of which a side and another side located at a position farthest from the former side are outwardly projected so as to be provided with flat-plate-shaped projections 6, and a height of the flat-plate-shaped projections is one of 0.2 mm, 3.3 mm, 0.5 mm, 0.75 mm, and 1.0 mm.

Figure 8B:
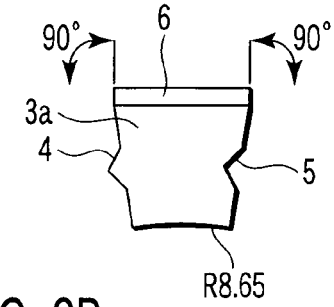
FIG. 8B is a cross-sectional view showing an outermost layer element wire for forming a flat-plate-shaped projection on an overhead cable having a cross-sectional shape of an equilateral polygon formed by the element wires one of which is shown in FIG. 8A.

In order to provide two flat-plate-shaped projections on the outermost layer, it is only required to use element wires 3*a* each having a projection in which a flat-plate-shaped projection 6 is integrally formed on the outer surface side of an element wire 3 shown in FIG. 8A as shown in FIG. 8B as two element wires of the outermost layer element wires.

Measurement of the drag coefficient at the time of no rainfall and at the time of a rainfall, and measurement of wind noise level were conducted by a wind tunnel experiment for each of these electric cables. The results are shown in Tables 4 to 13 for each group of the height of the flat-plate-shaped projections. According to these results, it can be seen that the higher the height of the flat-plate-shaped projections is the less the wind noise is.

In Tables 4 and 5, the measurement results of the drag coefficient and the wind noise level of the cables (1) to (7) obtained when the height of the flat-plate-shaped projections is 0.2 mm are shown.

TABLE 4

| Cable diameter d | Nominal cross-sectional area mm$^2$ | Number of angles N | Drag coefficient fundamental shape + flat plate projection projection height: 0.2 mm — Drag coefficient, no rainfall 20 m/s | 30 m/s | 40 m/s | Drag coefficient, rainfall 16 mm/10 min. 40 m/s | Execution Cd | Employment |
|---|---|---|---|---|---|---|---|---|
| 18.2 | 160 | 16 | 1.016 | 0.934 | 0.851 | 0.862 | 0.862 | ◎ |
| 22 | 240 | 17 | 1.032 | 0.949 | 0.814 | 0.796 | 0.814 | ◎ |
| 24.4 | 330 | 20 | 1.039 | 0.893 | 0.783 | 0.785 | 0.785 | ◎ |
| 27.4 | 410 | 20 | 1.081 | 0.935 | 0.725 | 0.756 | 0.756 | ○ |
| 27.4 | 410 | 21 | 1.026 | 0.921 | 0.720 | 0.743 | 0.743 | ◎ |
| 32.6 | 610 | 22 | 0.988 | 0.765 | 0.629 | 0.705 | 0.705 | ◎ |
| 38.4 | 810 | 22 | 0.913 | 0.696 | 0.606 | 0.719 | 0.719 | ◎ |

◎: excellent
○: very good

As shown in Table 4, in the case where the height of the projections was 0.2 mm, the drag coefficient was less than the normal cable by 14% in terms of the execution Cd value when the nominal cross-sectional area was 160 mm$^2$, and by 28% when the nominal cross-sectional area was 810 mm$^2$.

TABLE 5

| Cable diameter d | Nominal cross-sectional area mm$^2$ | Number of angles N | Wind noise level fundamental shape + flat plate projection projection height: 0.2 mm — Peak noise level 10 m/s | 15 m/s | 20 m/s | Employment |
|---|---|---|---|---|---|---|
| 18.2 | ACSR160 | | 44.0 | 56.1 | 71.6 | |
| 18.2 | 160 | 16 | 42.5 | 54.9 | 70.5 | ○ |
| 22.4 | ACSR240 | | 41.3 | 55.9 | 66.9 | |
| 22 | 240 | 17 | 33.6 | 53.7 | 58.5 | ○ |
| 25.3 | ACSR330 | | 34.7 | 55.0 | 63.3 | |
| 24.4 | 330 | 20 | 35.2 | 51.8 | 59.5 | ○ |
| 28.5 | ACSR410 | | 38.0 | 54.9 | 57.9 | |
| 27.4 | 410 | 20 | 33.9 | 52.5 | 56.8 | ○ |
| 27.4 | 410 | 21 | 34.2 | 51.6 | 55.4 | ○ |
| 34.2 | ACSR610 | | 34.9 | 51.2 | 54.0 | |

TABLE 5-continued

| Cable diameter d | Nominal cross-sectional area mm$^2$ | Number of angles N | Wind noise level fundamental shape + flat plate projection projection height: 0.2 mm — Peak noise level 10 m/s | 15 m/s | 20 m/s | Employment |
|---|---|---|---|---|---|---|
| 32.6 | 610 | 22 | 35.8 | 49.8 | 54.8 | Δ |
| 38.4 | ACSR810 | | 39.5 | 43.4 | 53.9 | |
| 38.4 | 810 | 22 | 38.9 | 47.7 | 54.6 | Δ |

○: very good
Δ: good

As shown in Table 5, in the case where the height of the projections was 0.2 mm, the wind noise showed values lower than the normal cables when the nominal cross-sectional area was 160 mm$^2$ to 410 mm$^2$, but showed values higher than the normal cables when the nominal cross-sectional area was 610 mm$^2$ and 810 mm$^2$.

Tables 6 and 7 below show measurement results of the drag coefficient and the wind noise of the cables (1) to (7) when the height of the flat-plate-shaped projections is 0.3 mm.

TABLE 6

| Cable diameter d | Nominal cross-sectional area mm$^2$ | Number of angles N | Drag coefficient fundamental shape + flat plate projection projection height: 3.3 mm — Drag coefficient, no rainfall 20 m/s | 30 m/s | 40 m/s | Drag coefficient, rainfall 16 mm/10 min. 40 m/s | Execution Cd | Employment |
|---|---|---|---|---|---|---|---|---|
| 18.2 | 160 | 16 | 1.018 | 0.933 | 0.857 | 0.884 | 0.884 | ◎ |
| 22 | 240 | 17 | 1.030 | 0.932 | 0.813 | 0.782 | 0.813 | ◎ |
| 24.4 | 330 | 20 | 1.061 | 0.902 | 0.791 | 0.784 | 0.791 | ◎ |
| 27.4 | 410 | 20 | 1.096 | 0.947 | 0.733 | 0.771 | 0.771 | ○ |
| 27.4 | 410 | 21 | 1.044 | 0.919 | 0.726 | 0.748 | 0.748 | ◎ |
| 32.6 | 610 | 22 | 0.981 | 0.742 | 0.640 | 0.710 | 0.710 | ◎ |
| 38.4 | 810 | 22 | 0.921 | 0.703 | 0.626 | 0.714 | 0.714 | ◎ |

◎: excellent
○: very good

As shown in Table 6, in the case where the height of the projections was 3.3 mm, the drag coefficient was less than the normal cable by 12% in terms of the execution Cd value when the nominal cross-sectional area was 160 mm$^2$, and by 29% when the nominal cross-sectional area was 810 mm$^2$.

TABLE 7

| Cable diameter d | Nominal cross-sectional area mm$^2$ | Number of angles N | Wind noise level fundamental shape + flat plate projection projection height: 3.3 mm — Peak noise level 10 m/s | 15 m/s | 20 m/s | Employment |
|---|---|---|---|---|---|---|
| 18.2 | ACSR160 | | 44.0 | 56.1 | 71.6 | |
| 18.2 | 160 | 16 | 41.2 | 52.6 | 68.1 | ○ |
| 22.4 | ACSR240 | | 41.3 | 55.9 | 66.9 | |
| 22 | 240 | 17 | 35.6 | 50.3 | 56.8 | ○ |
| 25.3 | ACSR330 | | 34.7 | 55.0 | 63.3 | |
| 24.4 | 330 | 20 | 35.1 | 49.2 | 56.2 | ○ |
| 28.5 | ACSR410 | | 38.0 | 54.9 | 57.9 | |
| 27.4 | 410 | 20 | 31.9 | 51.3 | 57.4 | ○ |
| 27.4 | 410 | 21 | 34.2 | 51.6 | 52.8 | ○ |
| 34.2 | ACSR610 | | 34.9 | 51.2 | 54.0 | |
| 32.6 | 610 | 22 | 34.6 | 48.2 | 52.4 | ○ |
| 38.4 | ACSR810 | | 39.5 | 43.4 | 53.9 | |
| 38.4 | 810 | 22 | 36.9 | 42.2 | 52.4 | ○ |

○: very good

As shown in Table 7, in the case where the height of the projections was 3.3 mm, the wind noise showed values lower than the normal cables when the nominal cross-sectional area was 160 mm$^2$ to 810 mm$^2$. Accordingly, it was confirmed that the shapes were effective for the nominal cross-sectional areas from 160 mm$^2$ to 810 mm$^2$.

Tables 8 and 9 below show measurement results of the drag coefficient and the wind noise level of the cables (1) to (7) obtained when the height of the flat-plate-shaped projections was 0.5 mm.

As shown in Table 8, in the case where the height of the projections was 0.5 mm, the drag coefficient was less than the normal cable by 11% in terms of the execution Cd value when the nominal cross-sectional area was 160 mm$^2$, and by 29% when the nominal cross-sectional area was 810 mm$^2$.

TABLE 9

| Cable diameter d | Nominal cross-sectional area mm$^2$ | Number of angles N | Wind noise level fundamental shape + flat plate projection projection height: 0.5 mm — Peak noise level 10 m/s | 15 m/s | 20 m/s | Employment |
|---|---|---|---|---|---|---|
| 18.2 | ACSR160 | | 44.0 | 56.1 | 71.6 | |
| 18.2 | 160 | 16 | 40.3 | 51.4 | 63.8 | ○ |
| 22.4 | ACSR240 | | 41.3 | 55.9 | 66.9 | |
| 22 | 240 | 17 | 34.7 | 48.6 | 54.3 | ○ |
| 25.3 | ACSR330 | | 34.7 | 55.0 | 63.3 | |
| 24.4 | 330 | 20 | 28.5 | 48.7 | 50.9 | ○ |
| 28.5 | ACSR410 | | 38.0 | 54.9 | 57.9 | |
| 27.4 | 410 | 20 | 29.9 | 50.8 | 57.6 | ○ |
| 27.4 | 410 | 21 | 31.8 | 52.0 | 50.8 | ○ |
| 34.2 | ACSR610 | | 34.9 | 51.2 | 54.0 | |
| 32.6 | 610 | 22 | 37.7 | 45.7 | 50.4 | ○ |
| 38.4 | ACSR810 | | 39.5 | 43.0 | 53.9 | |
| 38.4 | 810 | 22 | 37.6 | 42.7 | 51.2 | ○ |

○: very good

As shown in Table 9, in the case where the height of the projections was 0.5 mm, the wind noise showed values lower than the normal cables when the nominal cross-sectional area was 160 mm$^2$ to 810 mm$^2$. Accordingly, it was confirmed that the shapes each having flat-plate-shaped projections in each of which the height is 0.5 mm were effective for the nominal cross-sectional areas from 160 mm$^2$ to 810 mm$^2$.

Tables 10 and 11 below show measurement results of the drag coefficient and the wind noise level of the cables (1) to (7) obtained when the height of the flat-plate-shaped projections was 0.75 mm.

TABLE 8

| Cable diameter d | Nominal cross-sectional area mm$^2$ | Number of angles N | Drag coefficient of fundamental shape + flat plate projection projection height: 0.5 mm — Drag coefficient, no rainfall 20 m/s | 30 m/s | 40 m/s | Drag coefficient, rainfall 16 mm/10 min. 40 m/s | Execution Cd | Employment |
|---|---|---|---|---|---|---|---|---|
| 18.2 | 160 | 16 | 1.019 | 0.925 | 0.863 | 0.893 | 0.893 | ◎ |
| 22 | 240 | 17 | 1.028 | 0.927 | 0.811 | 0.784 | 0.811 | ◎ |
| 24.4 | 330 | 20 | 1.103 | 0.993 | 0.783 | 0.736 | 0.783 | ◎ |
| 27.4 | 410 | 20 | 1.081 | 0.935 | 0.760 | 0.764 | 0.764 | ○ |
| 27.4 | 410 | 21 | 1.026 | 0.921 | 0.758 | 0.751 | 0.758 | ◎ |
| 32.6 | 610 | 22 | 0.993 | 0.734 | 0.677 | 0.711 | 0.711 | ◎ |
| 38.4 | 810 | 22 | 1.021 | 0.703 | 0.622 | 0.712 | 0.712 | ◎ |

◎: excellent
○: very good

TABLE 10

| Cable diameter d | Nominal cross-sectional area mm² | Number of angles N | Drag coefficient, no rainfall 20 m/s | 30 m/s | 40 m/s | Drag coefficient, rainfall 16 mm/10 min. 40 m/s | Execution Cd | Employment |
|---|---|---|---|---|---|---|---|---|
| | | | Drag coefficient fundamental shape + flat plate projection projection height: 0.75 mm | | | | | |
| 18.2 | 160 | 16 | 1.093 | 0.979 | 0.933 | 0.902 | 0.933 | ◎ |
| 22 | 240 | 17 | 1.039 | 0.951 | 0.892 | 0.811 | 0.892 | ◎ |
| 24.4 | 330 | 20 | 1.023 | 0.896 | 0.741 | 0.788 | 0.788 | ◎ |
| 27.4 | 410 | 20 | 1.055 | 0.938 | 0.772 | 0.753 | 0.772 | ○ |
| 27.4 | 410 | 21 | 1.034 | 0.953 | 0.759 | 0.763 | 0.763 | ◎ |
| 32.6 | 610 | 22 | 0.995 | 0.766 | 0.702 | 0.726 | 0.726 | ◎ |
| 38.4 | 810 | 22 | 1.007 | 0.704 | 0.684 | 0.736 | 0.736 | ◎ |

◎: excellent
○: very good

As shown in Table 10, in the case where the height of the projections was 0.75 mm, the drag coefficient was less than the normal cable by 7% in terms of the execution Cd value when the nominal cross-sectional area was 160 mm², and by 26% when the nominal cross-sectional area was 810 mm².

TABLE 11

| Cable diameter d | Nominal cross-sectional area mm² | Number of angles N | Peak noise level 10 m/s | 15 m/s | 20 m/s | Employment |
|---|---|---|---|---|---|---|
| | | | Wind noise level fundamental shape + flat plate projection projection height: 0.75 mm | | | |
| 18.2 | ACSR160 | | 44.0 | 56.1 | 71.6 | |
| 18.2 | 160 | 16 | 31.7 | 43.6 | 48.2 | ○ |
| 22.4 | ACSR240 | | 41.3 | 55.9 | 66.9 | |
| 22 | 240 | 17 | 19.6 | 30.4 | 42.0 | ○ |
| 25.3 | ACSR330 | | 34.7 | 55.0 | 63.3 | |
| 24.4 | 330 | 20 | 26.8 | 35.1 | 45.1 | ○ |
| 28.5 | ACSR410 | | 38.0 | 54.9 | 57.9 | |
| 27.4 | 410 | 20 | 25.1 | 37.9 | 42.9 | ○ |
| 27.4 | 410 | 21 | 27.2 | 37.2 | 43.4 | ○ |
| 34.2 | ACSR610 | | 34.9 | 51.2 | 54.0 | |
| 32.6 | 610 | 22 | 32.6 | 38.4 | 44.3 | ○ |

TABLE 11-continued

| Cable diameter d | Nominal cross-sectional area mm² | Number of angles N | Peak noise level 10 m/s | 15 m/s | 20 m/s | Employment |
|---|---|---|---|---|---|---|
| | | | Wind noise level fundamental shape + flat plate projection projection height: 0.75 mm | | | |
| 38.4 | ACSR810 | | 39.5 | 43.0 | 53.9 | |
| 38.4 | 810 | 22 | 33.0 | 36.3 | 45.7 | ○ |

○: very good

As shown in Table 11, in the case where the height of the projections was 0.75 mm, the wind noise showed values lower than the normal cables when the nominal cross-sectional area was 160 mm² to 810 mm². Accordingly, it was confirmed that the shapes each having flat-plate-shaped projections in each of which the height is 0.75 mm were effective for the nominal cross-sectional areas from 160 mm² to 810 mm².

Tables 12 and 13 below show measurement results of the drag coefficient and the wind noise level of the cables (1) to (7) obtained when the height of the flat-plate-shaped projections was 1.0 mm.

TABLE 12

| Cable diameter d | Nominal cross-sectional area mm² | Number of angles N | Drag coefficient, no rainfall 20 m/s | 30 m/s | 40 m/s | Drag coefficient, rainfall 16 mm/10 min. 40 m/s | Execution Cd | Employment |
|---|---|---|---|---|---|---|---|---|
| | | | Drag coefficient fundamental shape + flat plate projection projection height: 1.0 mm | | | | | |
| 18.2 | 160 | 16 | 1.127 | 1.159 | 1.198 | 0.968 | 1.198 | X |
| 22 | 240 | 17 | 1.032 | 0.949 | 0.938 | 0.894 | 0.938 | ○ |
| 24.4 | 330 | 20 | 1.039 | 1.004 | 0.847 | 0.785 | 0.847 | ○ |
| 27.4 | 410 | 20 | 0.982 | 0.896 | 0.818 | 0.849 | 0.849 | ○ |
| 27.4 | 410 | 21 | 1.004 | 0.892 | 0.823 | 0.842 | 0.842 | ○ |
| 32.6 | 610 | 22 | 0.934 | 0.765 | 0.724 | 0.839 | 0.839 | ○ |
| 38.4 | 810 | 22 | 0.921 | 0.718 | 0.739 | 0.823 | 0.823 | ○ |

○: very good
X: bad

As shown in Table 12, in the case where the height of the projections was 1.0 mm, the drag coefficient was larger than the normal cable in terms of the execution Cd value when the nominal cross-sectional area was 160 $mm^2$, but when the nominal cross-sectional area was 240 $mm^2$, the drag coefficient was less than the normal cable by 6%, and less than the normal cable by 18% when the nominal cross-sectional area was 810 $mm^2$.

TABLE 13

| | | | Wind noise level fundamental shape + flat plate projection projection height: 1.0 mm | | | |
|---|---|---|---|---|---|---|
| | Nominal cross- | Number | Peak noise level | | | |
| Cable diameter d | sectional area $mm^2$ | of angles N | 10 m/s | 15 m/s | 20 m/s | Employment |
| 18.2 | ACSR160 | | 44.0 | 56.1 | 71.6 | |
| 18.2 | 160 | 16 | 31.8 | 40.8 | 43.1 | ○ |
| 22.4 | ACSR240 | | 41.3 | 55.9 | 66.9 | |
| 22 | 240 | 17 | 20.9 | 32.2 | 42.5 | ○ |
| 25.3 | ACSR330 | | 34.7 | 55.0 | 63.3 | |
| 24.4 | 330 | 20 | 23.2 | 32.8 | 41.9 | ○ |
| 28.5 | ACSR410 | | 38.0 | 54.9 | 57.9 | |
| 27.4 | 410 | 20 | 22.9 | 31.6 | 42.0 | ○ |
| 27.4 | 410 | 21 | 24.2 | 32.1 | 41.2 | ○ |
| 34.2 | ACSR610 | | 34.9 | 51.2 | 54.0 | |
| 32.6 | 610 | 22 | 23.6 | 33.4 | 42.5 | ○ |
| 38.4 | ACSR810 | | 39.5 | 43.0 | 53.9 | |
| 38.4 | 810 | 22 | 22.2 | 31.1 | 41.1 | ○ |

○: very good

As shown in Table 13, in the case where the height of the projections was 1.0 mm, the wind noise showed values lower than the normal cables when the nominal cross-sectional area was 160 $mm^2$ to 810 $mm^2$. Accordingly, it was confirmed that the shapes each having flat-plate-shaped projections in each of which the height is 1.0 mm were effective for the nominal cross-sectional areas from 160 $mm^2$ to 810 $mm^2$.

To summarize the experiment results described above, in order to make the wind pressure load of an overhead cable constituted of a naked stranded cable at the time of strong wind and a rainfall smaller than that of a normal cable, and make the wind noise thereof at a wind speed of 10 to 20 m/s smaller than that of a normal cable, it can be seen that shapes each of which has an equilateral polygon inscribed in a circle having a diameter from 18.2 mm to 38.4 mm as a fundamental cross-sectional shape, and in each of which two sides of the equilateral polygon that are located at positions farthest from each other are outwardly projected so as to be provided with flat-plate-shaped projections, the number of angles of the equilateral polygon is 16 when the diameter of the circle is 18.2 mm, the number of angles is 17 when the diameter is 22 mm, the number of angles is 20 when the diameter is 24.4 mm, the number of angles is 20 or 21 when the diameter is 27.4 mm, the number of angles is 22 when the diameter is 32.6 mm, the number of angles is 22 when the diameter is 38.4 mm, and the height of the flat-plate-shaped projections is equal to or larger than 0.3 mm and equal to or smaller than 0.75 mm are effective.

Figure 9:
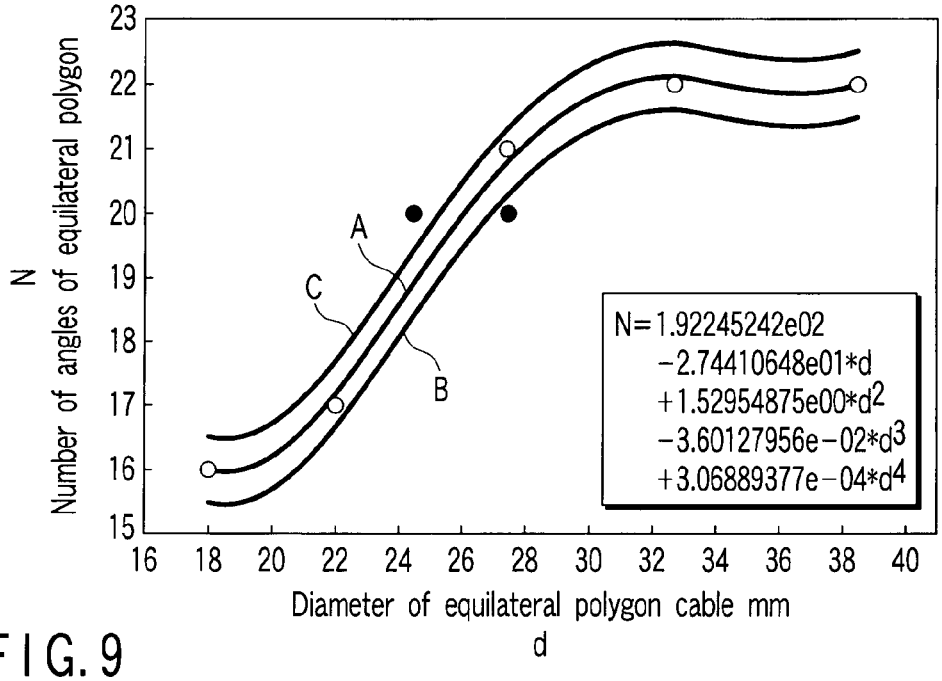
FIG. 9 is a graph showing a relationship between a diameter of a cable and the number of angles (sides) of an equilateral polygon of an overhead cable having a cross-sectional shape of an equilateral polygon and having flat-plate-shaped projections.

Next, when a relationship between the diameter and the number of angles of an overhead cable having a cross-sectional shape of an equilateral polygon, having flat-plate-shaped projections, and effective for both wind pressure load reduction and wind noise reduction is plotted on a graph in which the abscissa indicates a diameter of an overhead cable having a cross-sectional shape of an equilateral polygon, and the ordinate indicates the number of angles of an overhead cable having a cross-sectional shape of an equilateral polygon, the result is as shown in FIG. 9. As is evident from the graph shown in FIG. 9, it can be seen that there is a certain relationship between the diameter d and the number N of angles of an overhead cable having a cross-sectional shape of an equilateral polygon, and effective for both wind pressure load reduction and wind noise reduction. When the relationship is mathematized by a fourth degree polynomial, the following expression is obtained.

$$N=192.245242-27.4410648d+1.52954875d^2-0.0360127956d^3+0.000306889377d^4$$

When this relationship is shown on the graph of FIG. 9, a curve A is obtained. However, since the number of angles of an equilateral polygon takes a natural number, in consideration of alteration (rounding off of the number of angles) of −0.5 and +0.5 of the number of angles obtained from the above expression, the range of the number N of angles can be expressed as follows by the following expression.

$$192.245242-27.4410648d+1.52954875d^2-0.0360127956d^3+0.000306889377d^4-0.5<N<192.245242-27.4410648d+1.52954875d^2-0.0360127956d^3+0.000306889377d^4+0.5$$

When the above range is shown on the graph of FIG. 9, the range is the region between curves B and C.

When the number N of angles is expressed by the above expression, according to the results of Tables 4 to 13, in order to make the wind pressure load of an overhead cable constituted of a naked stranded cable at the time of strong wind and a rainfall smaller than that of a normal cable, and make wind noise thereof at a wind speed of 10 to 20 m/s smaller than that of a normal cable, shapes each of which has an equilateral polygon inscribed in a circle having a diameter from 18.2 mm to 38.4 mm as a fundamental cross-sectional shape, and in each of which two sides of the equilateral polygon that are located at positions farthest from each other are outwardly projected so as to be provided with flat-plate-shaped projections, a relationship between the number N of angles of the equilateral polygon and the diameter d of the circle is within the range of the following inequality, and the height of the flat-plate-shaped projections is equal to or larger than 0.3 mm and equal to or smaller than 0.75 mm are effective.

$$192.245242-27.4410648d+1.52954875d^2-0.0360127956d^3+0.000306889377d^4-0.5<N<192.245242-27.4410648d+1.52954875d^2-0.0360127956d^3+0.000306889377d^4+0.5$$

When the shapes of the electric cables are shapes each of which has an equilateral polygon inscribed in a circle having a diameter from 18.2 mm to 27.4 mm as a fundamental cross-sectional shape, and in each of which two sides of this fundamental cross-sectional shape that are located at positions farthest from each other are provided with flat-plate-shaped projections, it is also effective for making the wind pressure load of an overhead cable at the time of strong wind and a rainfall smaller than that of a normal cable, and making wind noise thereof at a wind speed of 10 to 20 m/s smaller than that of a normal cable that a relationship between the number N of angles of the equilateral polygon and the diameter d of the circle is within the range of the following inequality, and the height of the flat-plate-shaped projections is equal to or larger than 0.2 mm and equal to or smaller than 0.75 mm.

$$192.245242-27.4410648d+1.52954875d^2-0.0360127956d^3+0.000306889377d^4-$$

$$0.5<N<192.245242-27.4410648d+1.52954875d^2-0.0360127956d^3+0.000306889377d^4+0.5$$

Furthermore, when the shapes of the electric cables are shapes each of which has an equilateral polygon inscribed in a circle having a diameter from 22 mm to 38.4 mm as a fundamental cross-sectional shape, and in each of which two sides of the equilateral polygon that are located at positions farthest from each other are outwardly projected so as to be provided with flat-plate-shaped projections, it is also effective for making the wind pressure load of an overhead cable at the time of strong wind and a rainfall smaller than that of a normal cable, and making wind noise thereof at a wind speed of 10 to 20 m/s smaller than that of a normal cable that a relationship between the number N of angles of the equilateral polygon and the diameter d of the circle is within the range of the following inequality, and the height of the flat-plate-shaped projections is equal to or larger than 0.3 mm and equal to or smaller than 1.0 mm.

$$192.245242-27.4410648d+1.52954875d^2-0.0360127956d^3+0.000306889377d^4-0.5<N<192.245242-27.4410648d+1.52954875d^2-0.0360127956d^3+0.000306889377d^4+0.5$$

Figure 10:
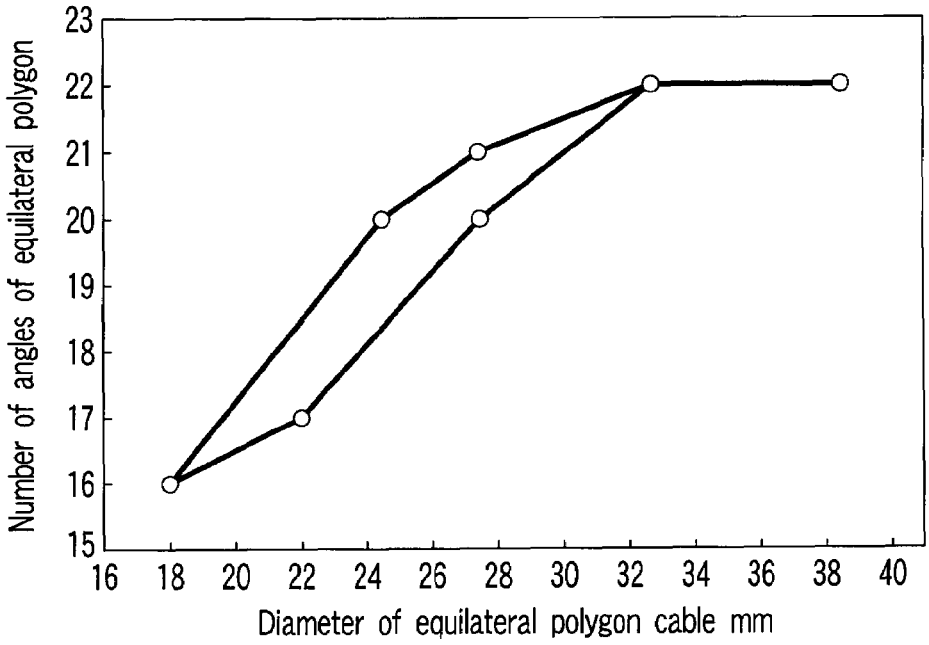
FIG. 10 is a graph formed by connecting measurement points of the graph of FIG. 9 by straight lines, and showing a range effective for reducing the wind pressure load and wind noise.

FIG. 10 is a graph formed by connecting measurement points of the graph of FIG. 9 by straight lines, and showing a range effective for reducing the wind pressure load and wind noise. According to this graph, in order to make the wind pressure load of an overhead cable constituted of a naked stranded cable at the time of strong wind and a rainfall smaller than that of a normal cable, and make wind noise thereof at a wind speed of 10 to 20 m/s smaller than that of a normal cable, it can be seen that shapes each of which has an equilateral polygon inscribed in a circle having a diameter from 18.2 mm to 38.4 mm as a fundamental cross-sectional shape, and in each of which two sides of the equilateral polygon that are located at positions farthest from each other are outwardly projected so as to be provided with flat-plate-shaped projections, and the number N of angles of the equilateral polygon is within a range surrounded by straight lines connecting points (d=18; N=16), (d=22; N=17), (d=27.4; N=20), (d=32.6; N=22), (d=38.4; N=22), (d=32.6; N=22), (d=24.4; N=20), and (d=18; N=16) on the rectangular coordinates in which the abscissa indicates the diameter d of the circle, and the ordinate indicates the number N of angles, and the height of the flat-plate-shaped projections is equal to or larger than 0.3 mm and equal to or smaller than 0.75 mm are effective.

Figure 11A:
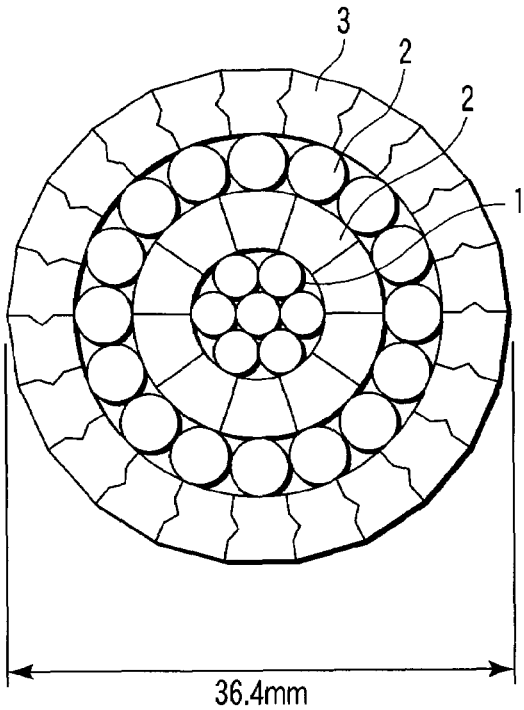
FIG. 11A is a cross-sectional view of an electric cable (nominal cross-sectional area is identical with those shown in FIGS. 7A and 7B) having a fundamental cross-sectional shape of an equilateral polygon having 22 angles and having an outer diameter of 36.4 mm.
Figure 11B:
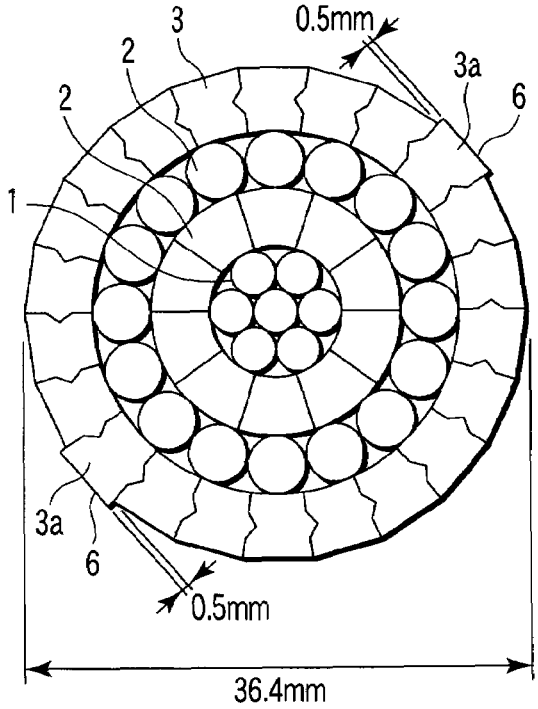
FIG. 11B is a cross-sectional view of an electric cable formed by forming flat-plate-shaped projections on the electric cable shown in FIG. 11A according to still another embodiment of the present invention.

By the way, in order to reduce the wind pressure load, reducing the diameter of an electric cable is also effective means. For example, the diameter of the electric cables shown in FIGS. 7A and 7B each having a nominal cross-sectional area 810 $mm^2$ is 38.4 mm. When one lay of inner layer aluminum element wires 2 are replaced with element wires each having a sectoral shape without changing the nominal cross-sectional area as shown in FIGS. 11A and 11B, the diameter can be reduced to 36.4 mm. When the diameter is reduced, the wind pressure load can be reduced correspondingly.

Figure 12A:
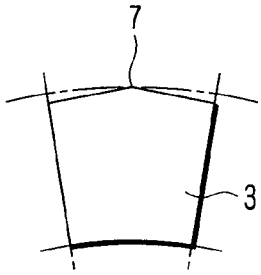
FIG. 12A is a cross-sectional view showing another example of an outermost layer element wire for forming an overhead cable having a cross-sectional shape of an equilateral polygon.
Figure 12B:
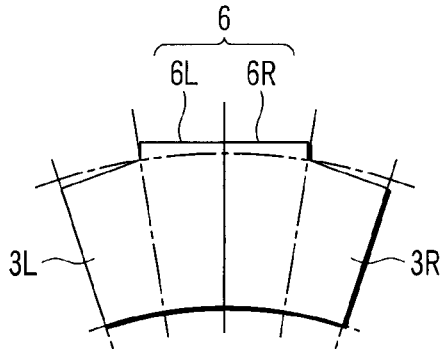
FIG. 12B is a cross-sectional view showing a pair of outermost layer element wires for forming a flat-plate-shaped projection on an overhead cable having a cross-sectional shape of an equilateral polygon formed by the element wires one of which is shown in FIG. 12A.

Furthermore, an overhead cable having a cross-sectional shape of an equilateral polygon can also be formed by stranding element wires 3 as shown in FIG. 12A in the outermost layer. This element wire 3 is formed, in cross section, into a triangular mountain shape in such a manner that the surface of a cable on the outer circumferential side forms the angle parts 7 of the equilateral polygon. When an electric cable having a cross-sectional shape of an equilateral polygon is formed by using the element wires 3 and flat-plate-shaped projections are formed on the outer circumferential surface thereof, it is sufficient to make an element wire 3R in which a right half 6R of the flat-plate-shaped projection is provided on the left side of the triangular mountain shape and an element wire 3L in which a left half 6L of the flat-plate-shaped projection is provided on the right side of the triangular mountain shape adjacent to each other, thereby stranding all the element wires 3R and 3L.

Furthermore, the present invention relates to a circumferential shape of an overhead cable, and hence the internal structure and the material of the overhead cable are not particularly limited. For example, the steel wire part of the electric cable can be constituted of aluminum wires or Invar wires, and the aluminum wire part thereof can also be constituted of heat-resistant aluminum alloy wires. Further, the present invention can be applied not only to the overhead cables but also to the overhead earth cables.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An overhead cable comprising a plurality of element wires stranded to form a naked stranded cable, which has a cross-sectional shape of an equilateral polygon inscribed in a circle having a diameter of 18.2 mm to 38.4 mm as a fundamental cross-sectional shape, in which adjacent sides of the equilateral polygon intersect with each other at an apex of the equilateral polygon, and two sides of this equilateral polygon that are located at positions farthest from each other are outwardly projected, has two flat-plate-shaped projections corresponding to the two sides, wherein the number of angles of the equilateral polygon is 16 when the diameter of the circle is 18.2 mm, the number of angles is 17 when the diameter is 22 mm, the number of angles is 20 when the diameter is 24.4 mm, the number of angles is 20 or 21 when the diameter is 27.4 mm, the number of angles is 22 when the diameter is 32.6 mm, or the number of angles is 22 when the diameter is 38.4 mm, and a height of the flat-plate-shaped projections is equal to or larger than 0.3 mm and equal to or smaller than 0.75 mm.

2. The overhead cable according to claim 1, wherein an outermost layer of the naked stranded cable is a layer formed by coupling a plurality of element wires in each of which a concave part is provided on one side surface and a convex part is provided on the other side surface to each other in such a manner that a convex part of one side surface of one of two adjacent element wires is fitted in a concave part of one side surface of the other element wire.

3. An overhead cable comprising a plurality of element wires stranded to form a naked stranded cable, which has a cross-sectional shape of an equilateral polygon inscribed in a circle having a diameter of 18.2 mm to 38.4 mm as a fundamental cross-sectional shape, in which adjacent sides of the equilateral polygon intersect with each other at an apex of the equilateral polygon, and two sides of this equilateral polygon that are located at positions farthest from each other are outwardly projected, has two flat-plate-shaped projections corresponding to the two sides, wherein the number N of angles of the equilateral polygon and the diameter d of the circle satisfy the following equation $$192.245242-27.4410648d+1.52954875d^2-0.0360127956d^3+0.000306889377d^4-0.5<N<192.245242-27.4410648d+1.52954875d^2-0.0360127956d^3+0.000306889377d^4+0.5, \text{ and}$$

a height of the flat-plate-shaped projections is equal to or larger than 0.3 mm and equal to or smaller than 0.75 mm.

4. The overhead cable according to claim 3, wherein an outermost layer of the naked stranded cable is a layer formed by coupling a plurality of element wires in each of which a concave part is provided on one side surface and a convex part is provided on the other side surface to each other in such a manner that a convex part of one side surface of one of two adjacent element wires is fitted in a concave part of one side surface of the other element wire.

5. An overhead cable comprising a plurality of element wires stranded to form a naked stranded cable, which has a cross-sectional shape of an equilateral polygon inscribed in a circle having a diameter of 18.2 mm to 27.4 mm as a fundamental cross-sectional shape, in which adjacent sides of the equilateral polygon intersect with each other at an apex of the equilateral polygon, and two sides of this equilateral polygon that are located at positions farthest from each other are outwardly projected, has two flat-plate-shaped projections corresponding to the two sides, wherein the number N of angles of the equilateral polygon and the diameter d of the circle satisfy the following equation $$192.245242-27.4410648d+1.52954875d^2-0.0360127956d^3+0.000306889377d^4-0.5<N<192.245242-27.4410648d+1.52954875d^2-0.0360127956d^3+0.000306889377d^4+0.5, \text{ and}$$

a height of the flat-plate-shaped projections is equal to or larger than 0.2 mm and equal to or smaller than 0.75 mm.

6. The overhead cable according to claim 5, wherein an outermost layer of the naked stranded cable is a layer formed by coupling a plurality of element wires in each of which a concave part is provided on one side surface and a convex part is provided on the other side surface to each other in such a manner that a convex part of one side surface of one of two adjacent element wires is fitted in a concave part of one side surface of the other element wire.

7. An overhead cable comprising a plurality of element wires stranded to form a naked stranded cable, which has a cross-sectional shape of an equilateral polygon inscribed in a circle having a diameter of 22 mm to 38.4 mm as a fundamental cross-sectional shape, in which adjacent sides of the equilateral polygon intersect with each other at an apex of the equilateral polygon, and two sides of this equilateral polygon that are located at positions farthest from each other are outwardly projected, has two flat-plate-shaped projections corresponding to the two sides, wherein the number N of angles of the equilateral polygon and the diameter d of the circle satisfy the following equation $$192.245242-27.4410648d+1.52954875d^2-0.0360127956d^3+0.000306889377d^4-0.5<N<192.245242-27.4410648d+1.52954875d^2-0.0360127956d^3+0.000306889377d^4+0.5, \text{ and}$$

a height of the flat-plate-shaped projections is equal to or larger than 0.3 mm and equal to or smaller than 1.0 mm.

8. The overhead cable according to claim 7, wherein an outermost layer of the naked stranded cable is a layer formed by coupling a plurality of element wires in each of which a concave part is provided on one side surface and a convex part is provided on the other side surface to each other in such a manner that a convex part of one side surface of one of two adjacent element wires is fitted in a concave part of one side surface of the other element wire.

9. An overhead cable comprising a plurality of element wires stranded to form a naked stranded cable, which has a cross-sectional shape of an equilateral polygon inscribed in a circle having a diameter of 18.2 mm to 38.4 mm as a fundamental cross-sectional shape, in which adjacent sides of the equilateral polygon intersect with each other at an apex of the equilateral polygon, and two sides of this equilateral polygon that are located at positions farthest from each other are outwardly projected, has two flat-plate-shaped projections corresponding to the two sides, wherein the number N of angles of the equilateral polygon is within a range surrounded by straight lines connecting points (d=18; N=16), (d=22; N=17), (d=27.4; N=20), (d=32.6; N=22), (d=38.4; N=22), (d=32.6; N=22), (d=27.4; N=21), (d=24.4; N=20), and (d=18; N=16) on rectangular coordinates in which an abscissa indicates the diameter d of the circle, and an ordinate indicates the number N of angles, and a height of the two flat-plate-shaped projections is equal to or larger than 0.3 mm and equal to or smaller than 0.75 mm.

10. The overhead cable according to claim 9, wherein an outermost layer of the naked stranded cable is a layer formed by coupling a plurality of element wires in each of which a concave part is provided on one side surface and a convex part is provided on the other side surface to each other in such a manner that a convex part of one side surface of one of two adjacent element wires is fitted in a concave part of one side surface of the other element wire.

* * * * *